US010676265B2

(12) United States Patent
Levneff et al.

(10) Patent No.: US 10,676,265 B2
(45) Date of Patent: Jun. 9, 2020

(54) COMPOSITIONAL NOTEBOOK/DIARY WITH CONCEALED POCKET FOR VALUABLES

(71) Applicants: Liya Levneff, Forest Hills, NY (US); Yuriy Leviyev, Forest Hills, NY (US)

(72) Inventors: Liya Levneff, Forest Hills, NY (US); Yuriy Leviyev, Forest Hills, NY (US)

( * ) Notice: Subject to any disclaimer, the term of this patent is extended or adjusted under 35 U.S.C. 154(b) by 0 days.

(21) Appl. No.: 16/104,248

(22) Filed: Aug. 17, 2018

(65) Prior Publication Data

US 2018/0354698 A1 Dec. 13, 2018

Related U.S. Application Data

(63) Continuation-in-part of application No. 15/447,437, filed on Mar. 2, 2017, now abandoned.

(51) Int. Cl.

| | |
|---|---|
| ***B65D 77/00*** | (2006.01) |
| ***A45C 1/08*** | (2006.01) |
| ***B42D 3/02*** | (2006.01) |
| ***B42D 3/18*** | (2006.01) |
| ***B42D 1/00*** | (2006.01) |
| ***B42F 13/00*** | (2006.01) |

(Continued)

(52) U.S. Cl.

CPC ..... *B65D 77/006* (2013.01); *A45C 1/08* (2013.01); *A45C 11/182* (2013.01); *B42D 1/00* (2013.01); *B42D 1/003* (2013.01); *B42D 3/02* (2013.01); *B42D 3/18* (2013.01); *B42D 5/003* (2013.01); *B42F 13/0066* (2013.01); *A45C 2001/083* (2013.01); *A45C 2011/186* (2013.01); *B42F 17/30* (2013.01); *B42P 2201/06* (2013.01); *B42P 2221/10* (2013.01)

(58) Field of Classification Search

CPC ..... B65D 77/006; A45C 1/08; A45C 11/182; A45C 2011/186; A45C 2001/083; B42D 1/00; B42D 5/003; B42D 3/18; B42D 3/02; B42D 1/003; B42F 13/0066; B42F 17/30; B42P 2221/10; B42P 2201/06

USPC ..... 281/3.1, 4, 15.1, 27.3, 29, 31, 45; 283/63.1, 64

See application file for complete search history.

(56) References Cited

U.S. PATENT DOCUMENTS 4,467,920 A * 8/1984 Smith ..... B65D 77/006 109/59 R

D386,677 S * 11/1997 Abiteboul ..... D19/26

(Continued)

*Primary Examiner* — Justin V Lewis

(57) ABSTRACT

A valuables-holding device in the form of a booklet which appears, when closed, to be an ordinary compositional notebook or pocket diary has a flange or transparent overlay extending around three sides of the inside front cover. A flexible covering plate, with its edge secured to the spine of the booklet, has its free edge capable of being slid behind the overlay. This will cover the space between the back of the covering plate and the inside surface of the front cover of the booklet. The covering plate can be slid out of the overlay, too, to expose that space. Secured to the inside of the front cover is a credit card organizer. The front cover and the covering plate are both preferably formed with a thin sheet of metal. Thus, the space between those components is electronically sealed or blocked from an RFID reader. The covering plate includes a slot for sliding paper money therethrough and into the space between the back of the credit card organizer and the inside surface of the front cover.

5 Claims, 3 Drawing Sheets

(51) Int. Cl.

| | |
|---|---|
| ***B42D 5/00*** | (2006.01) |
| ***A45C 11/18*** | (2006.01) |
| *B42F 17/30* | (2006.01) |

(56) References Cited

U.S. PATENT DOCUMENTS

| | | | | |
|---|---|---|---|---|
| 2001/0035367 | A1* | 11/2001 | Cliff | A47F 3/005<br>206/472 |
| 2007/0221818 | A1* | 9/2007 | Donayre | A45C 11/34<br>248/690 |
| 2016/0022000 | A1* | 1/2016 | Tucker-Skow | A45C 11/182<br>150/147 |
| 2016/0374442 | A1* | 12/2016 | Zhang | A45C 11/182<br>150/147 |

* cited by examiner

COMPOSITIONAL NOTEBOOK/DIARY WITH CONCEALED POCKET FOR VALUABLES

RELATED APPLICATIONS

The present application is a continuation-in-part application of now-pending and prior filed application Ser. No. 15/447,437, filed Mar. 2, 2017. That application and its teachings, comprising the written specification and drawings, are incorporated herein by reference.

FIELD OF THE INVENTION

The present invention relates to a disguised notebook/diary/wallet for secretly holding credit cards, a driver's license, paper copies of registrations for vehicles, and paper currency, but camouflaged within an ordinary-looking notebook or pocket diary so the same appears to look like a personal journal, a book or diary rather than a valuables-holding wallet. This will deter thieves from taking the same in an attempted robbery as the thief will be led to believe that the written or lined pages denote personal notes or a daily page calendar when, indeed, the device is holding the owner's valuables. The notebook or booklet may have a pen on its spine to further camouflage or conceal the function of the device and to visually "trick" or fool a would-be thief so as to believe the victim if he/she is the subject of an attempted robbery and indicates that he/she has no money, nor credit cards and no wallet. The wallet looks like a personal or pocket diary or, preferably, an ordinary and small, writer's compositional notebook and thus visually appears much less likely to be a wallet or a holder of valuables. The pen may be held to the invention by a sleeve, ring, string or other means. The notebook or diary (hereinafter for ease often referred to as "a booklet" or "a book") has a front and back cover. Between the covers, secured together and by a spine, are pages of the booklet. Preferably the covers are thin enough to allow for ease of manufacture, are lightweight, and thus easy to carry in one's purse or pocket but, desirably, thick enough so that the presence within the booklet of credit cards is not easily detected by a thief. Thus, the tactile feel of the outer coverings is meant to be thick enough so as to camouflage or disguise that the booklet is holding valuables. Preferably, this is done by having the front and back covers made of thick cardboard and/or with layers of metal. The sheet layers of metal serve to both provide a tactile block to the contents of the booklet and to block an RFID reader device from scanning data from the credit cards contained by the device.

In one and the preferred embodiment, the front and back covers are lined with thin layers of metal sheets. These serve to block an RFID reader so that the data magnetically contained on the credit cards cannot be easily obtained by an unauthorized RFID reader.

To hold and protect the credit cards, the inside of the front (and/or back) cover is provided with one or more vertically stacked and staggered holding pockets for credit cards—much in the manner of conventional wallets and purses which now provide vertically stacked holding of multiple credit cards. Behind the credit card holder(s), i.e., between the inside surface of the cover(s) and the rear of the staggered credit card organizer or holder (with stacked credit cards held therein) is a small holding area, a space or pocket for retaining folding and/or paper money. The paper money holding or storage area and the credit card organizer are concealed from view by a thin, covering plate which turns like a sheet of paper from covering the inside cover of the booklet to revealing the same, when the covering plate is suitably manipulated. This requires the end or edges of the covering plate to be slid out from a set of overlays or flanges, connected to the inside edges of the front cover. The covering plate is preferably a thin, possibly metal lined, malleable or bendable/rollable page which has three edges which slip into and out of holding overlays on three sides of the inside front cover. The overlays serve to hold the covering plate in position, unless and until the user needs access to one or more credit cards and/or the paper money. Then, the covering plate can be slid out of the overlays, the covering plate turned like a page to reveal the otherwise hidden pocket of the booklet and thus the user has access to the vertically staggered credit cards of the organizer and/or access to the paper money. In one embodiment of the invention, the covering plate is provided with one or more vertical side slots (near the spine of the booklet) to allow the user to slide paper money therethrough and into the area behind the credit card organizer or holder. This hides the same.

The present invention is thus directed to a booklet which serves to camouflage the presence of credit cards and paper money. The booklet has several ordinary pages extending from the spine and between the front and rear covers. Paper money and credit cards are protected from immediate view by a covering plate, which can be selectively turned or removed from its concealing location to allow access to the credit cards and the paper money. The booklet, preferably, has one or more of its covers provided with an outside (front and/or back) layer or thick cover and one or more covering plates. One or both of the covers and one or both of the covering plates can be formed from a thin sheet of metal which serves to block RFID readers from gaining access to the data on the credit cards. The credit cards are meant to be held, when not in use, between the inside surface of the cover and the opposed covering plate. The covering plates visually and physically block or allow access to the credit card organizer and the paper money within the normally hidden area. In one embodiment, the front and rear covers are lined with a sheet of metal so that the booklet is RFID secured. In another and the preferred embodiment, the covering plate (a thin sheet of flexible material) can also be lined with a layer or metallic sheet to block unwarranted RFID reader's gaining illicit access. And, the covering plates, are flexible and malleable, like a page within the booklet, so that they can be easily slid behind the holding overlays and slid out therefrom when access is desired. The overlays are inward from the edge extensions of the cover(s) and provide a three-sided, continuous flange on the inside of the cover of the booklet. The overlay will provide the securing mechanism for the covering plate to have its edges slide behind and will allow the covering plate to be slid out therefrom to gain access to the credit card organizer and the paper money.

The pages of the book can be full (extending from spine to edge, top to bottom) and lined or blank pages and serve to provide a very efficient and multi-use device, suitable for keeping notes, appointments, thoughts, etc. while also serving as a camouflaged wallet for credit cards and paper money.

BACKGROUND OF THE INVENTION

The present invention relates to a camouflaged and valuables-protecting wallet, in the form of a book or booklet, like a pocket diary or small compositional notebook. The basic device comprises a pair of outside covers and a set of paper sheets therebetween. The user's valuables, primarily consisting of credit cards and paper money can be concealed in an area or pocket/compartment located between either or both of the outer covers of the book and a thin movable cover plate adjacent thereto. The movable (it turns like a page turns, extending from the spine of the booklet) cover plate can slide into and out of a set of plastic flanges or overlays which extend inwardly (with respect to the cover's edges) and on the inside of the top, bottom, and outside (as opposed to the spine) edge of the cover(s). When the movable plate has its free edges slid beneath the flanges or overlays, the area behind the front (and/or rear) cover and the adjacent covering plate serves as a holding area for paper money and/or an organizer for one or more vertically stacked and staggered credit cards. When the covering plate or sheet is rolled or slid out or removed from the overlays/flanges, and turned as a page of the booklet, the paper money and credit card holder (staggering the top edges of the credit cards in a standard manner) are easily accessible. And, as mentioned, the present invention is intended to have one or more of the covers and/or covering plate(s) formed of a thin metallic layer or sheet to protect the data on the magnetic strips of the credit cards from being read by an RFID reader.

The thrust of the device and its function is to deceive and thereby prevent thieves and others from finding or recognizing a valuables-containing wallet, thereby deterring theft of precious materials, e.g., driver's license, credit cards, and paper money. Theft is a common problem and one that can be encountered anytime or anywhere. It can sometimes happen when a person's possessions are left unattended or unwatched. In that case, a thief is likely to dig through a purse or bag or other possessions looking for a conventional wallet to find money, credit cards, or sellable identifying information. Theft cannot be avoided simply by attending to one's possessions though. Thieves are also known to physically stop individuals and demand money or a wallet, often threatening violence if the victim does not comply, or simply taking objects directly off of the owner as is the case with pickpockets.

Even further, documents such as passports and credit cards that contain magnetic and readable strips or RFID strips or tags pose the risk of being discretely and unlawfully scanned without the owner's knowledge and the information contained therein then being used, stolen, sold quickly and then improperly used. When a thief having an electronic scanner (an RFID reader) is in the proximity of the credit cards or magnetically encoded strips on documents, he can scan the card or document's magnetic strip without having physical possession or access to the actual card or document. In that scenario, an unsavory individual nearby can scan and steal information without the owner even being aware. He can then use or sell the same. However, if the magnetic strips (with the data) are housed or covered within or between thin layers of metal, the RFID reader is blocked. From a security perspective, this is highly desirable.

Various articles have been developed to combat the threat of theft, including wallets which secure tightly against a user's body underneath clothing, pockets within waist belts for holding valuables, wallets that are chained to a belt, wallets requiring keys, and electronic passwords and signatures for opening of the same. However, many of these articles make it difficult for even the owner to reach his valuables within the wallet. Other developments, such as electronic passcodes, can be worked around in time. The present invention is a conventional-looking pocket diary or booklet with hidden areas for holding credit cards and paper money, all with metal sheets protecting against improper RFID reading of the data on the same.

There remains a need for a simple wallet or valuables-carrying device that visually presents as another object and that defends against electronic scanning while still being easy to carry, access, and use. The present invention conceals a wallet or pocket/compartment(s) within a diary, a notebook, a composition looking notebook, i.e., a pad of paper meant to look like a personal calendar, diary or journal, which appears to be of no use to anyone but the owner himself. The notebook further has one or more metal plates sandwiching the credit cards or the front and back covers are metal sheet lined to prevent digital scanning of the materials contained within the interior holding compartments, as well. In an alternate embodiment, the device resembles an ordinary pocket diary, calendar, a thin notebook, etc. with many sheets of ordinary writing paper secured to the spine. The covers (front and rear) are formed with thin, metallic sheets (preferably copper, aluminum, silver and/or gold or alloys thereof). On the inside of the front and rear covers, spaced from the front and rear covers, can be a second layer of thin, metallic material. This covering page or plate will be alternatively held within a set of contiguous overlays of the covers of the booklet or removed from the flanges or overlays to expose the credit card organizer and pocket money holding areas. Between the covering plate and the inside surface of the outer covers of the booklet, a holding pocket (actually two such pockets—one at the front, one at the rear of the booklet) for an organizing, stacking rack of credit cards and paper money space/compartments can be provided. The overlays or flanges are preferably thin, transparent and plastic, more preferably they are a continuous three sided, inwardly directed border of the inside surface of the front and rear covers, all to selectively capture and release the edges of the covering plate.

A camouflaging booklet for valuables which also protects the same from RFID readers is a goal sought to be provided by the present invention. It is desirable to have the same lightweight, inexpensive, attractive and functional.

SUMMARY OF THE INVENTION

The present invention provides a camouflaging, valuables-holding device. In the preferred embodiment, the device takes the form of a pocket diary or wallet or simple booklet with front and rear covers and writing pages therebetween. The pages are held to the spine of the booklet in a conventional manner. A holding compartment for storing cash, credit cards, driver's license, a passport, etc., is provided between at least one of the covers and a covering plate. The plate hides the valuables-holding pocket. It is slid into and out of a set of flanges or overlays which follow closely along the inside perimeter of at least the front and rear cover. However, the pocket or cavity(ies) for the credit card organizer and the foldable paper money area is(are) concealed in a personal, compositional-looking notebook or other booklet with pages, possibly having an attached pen to further the visual effect of camouflage and disguise. From the outside and to the unwary, the closed invention will be indistinguishable from a typical personal composition notebook, booklet or pocket diary. Because the wallet or pocket or cavities are concealed in the booklet or notebook, those encountering it will not immediately appreciate or know that it is a wallet with valuables and thus money, credit cards, passports, and other documents can be easily hidden from thieves and others. Those who encounter the compositional-looking booklet of lined pages with one or more hidden holding compartment(s) are likely to believe that it is only a person's personal notebook, a pocket calendar, booklet, etc. full of daily notes, poems, musings, or appointments and of little value to anyone but the owner. However, located between the cover(s) and a covering plate (thin, foldable and malleable, for ease of use) is a holding area for one or more sets of credit card stacking holders (organizers) and behind those, a small area for secreting foldable paper money. The storage area for the paper money is accessible, for placing money therein, through one or more slots through the covering plate. Those slots are near the spine. However, to remove one or more credit cards and/or paper money, the covering plate needs to be slid out from under the flanges/overlays. Then the covering plate is turned, like a page to expose the organizer and the paper money holding space. This will expose the credit cards and the paper money, as desired.

The invention appears from the outside to be a typical personal pocket diary/notebook with lined paper. It has two outside covers, front and rear, connected by a central spine. A set of pages is bound at the spine between the covers. The book/booklet provides a camouflaging visual effect which can be enhanced by having an attached pen. The notebook has several stacked and preferably lined pages bound to the central spine. Preferably, the covers are thick, e.g., cardboard, thicker than pages, to provide a tactile blocking of the items contained in the holding pockets, i.e., materials between the inside of the front and back cover and the covering plate. That tactile blocking will ensure that a thief will not recognize the presence of credit cards in the holding area, even though the thief may feel the outside of the booklet. Yet, the thickness for a tactile blocking can be provided by a layer of metal which will also serve to block the otherwise penetrating electromagnetic waves of an RFID reader.

The notebook may be hard cover or soft cover, although soft cover is preferred to reduce weight and therefore minimize discomfort in carrying for the user. But, that cover is itself thick enough to prevent feeling of the credit cards in the holding pocket or, the holding pocket is lined with thick and tactile insulating material or a thin sheet of RFID blocking metal. The lined and stacked interior writing pages form, like any booklet, aligned top, bottom and outside edges (opposite the bound edge at the spine). Thus, the camouflage wallet appears to be a book or booklet. The front and/or back hidden pockets of the booklet can be provided with one or more sets of credit card organizers, i.e., vertically stacked and vertically edge staggered holders for credit cards. These are held within the front (and/or rear) of the book, covered by a thin, possibly and preferably metallic, malleable sheet or covering plate. The covering plate is like the front page of the book but its free outside edge, top, and bottom edges are capable of being slid into and behind a set of overlapping flanges or an overlay which extends inwardly from the inside edges of the front (and/or rear) cover. When the covering plate's perimeter edges are beneath the flanges or the overlay, a compartment is formed between the front surface of the covering plate and the inside surface of the front cover. It is here that the credit card organizer(s) can be located. To gain access, the edges of the covering plate must be slid out from behind the overlay or flanges. Then the credit cards can be easily removed. And, behind the credit cards (and the organizer(s)) is a small space/area or compartment for storage of folding or paper money. This too can be accessed when the covering plate is removed from the overlay and flanges. Yet, according to the invention, the covering plate is provided with one or more side slots (near to the spine) to allow the user to insert paper money therethrough and thus into the area behind the credit card organizer. The side slots are closely adjacent the inside spine of the booklet.

To further deceive thieves as to the utility of the notebook, the invention also includes an attached pen. The pen may be attached by a variety of means including an elastic pen holding strap positioned on the side of the notebook, a pen-holding pocket, connecting string and/or a snap connection extending around the barrel of the pen. Preferably the book is slightly originally tattered or visually worn as it is intended to give the appearance to a thief that the book is for taking notes, writing down things to remember, poetry, musings, etc., anything but a holding pocket or camouflage wallet for credit cards, folding money and/or valuables. The preferred embodiment includes a small flange or inwardly directed ledge (a set of connected, preferably transparent overlays) extending from the free edges of the cover(s) for sliding the free edges of the covering plate beneath and into and out thereof so as to have the cover plate conceal the credit card organizer and the holding pocket for the paper funds and to reveal, as desired, the same.

The invention may also include at least one metal plate, preferably embedded in the front cover of the invention, although two plates can be provided, one in each cover. The metal plate provides some rigidity to the device but most importantly blocks a tactile feel of any credit cards within the device and also prevents electronic scanners from reaching and reading the magnetic strips, tags, electronic contents of the materials held within the booklet/notebook. This protects documents having machine readable strips or RFID tags from being scanned electronically by thieves within scanning range who are likely to use or sell the information obtained from these documents. The metal is preferably thin, likely flexible, light weight and sufficiently visually covered inside the book cover or sandwiched with fabric or material to present a book cover which is realistic and to prevent scratches or other damage to or from the corners of the metal plate.

The front and back areas of the book, between the inside surfaces of the cover plate(s) and the inside surface of the covers of the book are provided with credit card, vertically stacking and staggered organizers for holding credit cards. Behind the credit card organizers is a paper holding space or area for folding currency. Access to the credit card holding organizer(s) and the paper money holding area is blocked by a covering plate, which has its free edges slidable into and beneath the flanges/overlays on the inside of the outer cover(s). Removing the cover plate from the holding flanges provides access to the credit card organizers and the paper money holding space or pocket. And, in the preferred embodiment, the cover plates are provided with one or more slots (extending parallel to the spine of the book) which extend through the covering plate and into the area behind the organizer of the credit card holders.

In the preferred embodiment, the front and back cover of the book are lined with an RFID resistant blocking material so that the owner can pass near and even through RFID readers without the data from their credit cards being read. Preferably, the RFID protector sheets are made from copper sheets, or silver or aluminum. It has been discovered that those materials, even very thin sheets, are fine for blocking RFID reader devices. However, so, too, is a gold sheet. However, balancing cost versus efficacy in blocking RFID readers, it has been determined that protective and covering sheets or covers for the booklets can and should be made of copper, preferably, then from aluminum, and then silver, with gold being the least desirable (primarily due to cost). Alloys of the same can be used, too. According to the preferred embodiment of the present invention, the covers or protective sheets or covering plates which surround the credit cards (held in the pockets of the organizer within the notebook or diary) are in the range of only about a few millimeters. It has been found that a thin metallic sheet absorbs RFID waves readily and the skin depth needed for substantial absorbing (and thus protecting) of the data on the credit cards from the RFID reader) need not be large. Indeed, it can be quite thin and thus a metallic layer, even a flexible metal sheet, is suitable and does not add great expense. Other suitable RFID blockers could be graphene (a one atom of carbon thickness in a regular hexagonal pattern, having strong, lightweight and flexible properties and, yet conductive to enable electrons to flow faster than in silicon). This, it has been discovered, can also block radio waves, hence it is promising as an RFID reader blocker. Also, an aluminum and iron oxide particle mixed into a paint may be a suitable blocker of wireless signals. The covers and/or the covering plate can be coated with thin metal sheets, the paint, or graphene, all to advantage.

Credit cards and governmental passports use a relatively standard set of radio frequencies for magnetic data stored thereon. Most if not all banks use contactless payment cards operating at about 13.56 Mhz. Security pass keys and product ID (RFID) tags generally operate at about 125 kHz as well as 13.56 Mhz. While most RFID systems are designed to read and work at a short range, typically mere inches, cards can be read at up to a meter with powerful RFID readers and there is a real concern for even 30+ meters being used by hackers. Thus, the need for a wallet, for protecting credit card data and yet allowing ease of physical access to the cards and paper money presents counterveiling concerns. A wallet, with the security of layers of metal, hidden into a pocket diary or booklet, however, is a solution to the problem of thieves and to RFID hackers/readers.

Generally, an RFID blocking magnetic card reading shield or protector works in one of several ways. They are either passive or active. Passive shields or protectors will absorb the RFID signal or deflect it. A thin layer or sheet over the credit cards of the present wallet-like device (but camouflaged) will block the RFID reader from taking the data. Active RFID shields or protectors work, too, but require a micro-chip and typically send out an interfering signal to "confuse" the RFID reader. It is effectively pretending to be another card with different data causing a card "clash" of the data by the RFID hacker. Or, it could be designed to drain the power from the transmitting signal required to power the chip in one's credit card. If the chip can't receive enough power to function, it cannot transmit a reply to the RFID reader's signal. The use of an active RFID blocker is not preferably contemplated by the present invention. Rather, the present device, in its preferred embodiment, relates to a small booklet, diary, book, calendar, etc. which has locations for storing of credit cards, hidden behind two separated layers of thin metal, preferably copper, aluminum, silver even gold (or their alloys) to block RFID readers from stealing the data from the cards and, yet, the same device has hidden back pockets for paper money. The combination of features, in an inexpensive, lightweight, convenient to use device is remarkable and, yet, a thief/robber, will not necessarily even recognize the same as a source of monetary funds to the owner. The thief will likely ignore the device and move on to another victim.

Thus, when a thief or the owner opens the book at or about the middle, those pages can be fully compositional (preferably lined) pages and there is no showing of the credit cards nor paper currency.

When the notebook is closed, it appears to be a regular, everyday compositional notebook or booklet because the top, bottom, and free side edges of its pages and the connecting spine for the pages are all visible and provide the illusion of an intact compositional notebook or booklet. The notebook is intended to be bound by thicker-than-paper front and back covers, the front and/or rear cover preferably having a metal plate embedded (preferably RFID blocking material), attached and/or sandwiched therein. This metal layer, also "hidden" from normal view, prevents digital scans of contents of the notebook or the "camouflage" wallet, which might contain machine readable cards, such as passports, credit cards, etc., and the plate prevents signals from a scanner from infiltrating through the plate and into the compartment holding those sensitive materials. Thus, a user is able to prevent physical theft of valuable objects by disguising them in an everyday object of little worth and the device also prevents digital theft by preventing a magnetic strip reading scanner from reaching the material contained within the compartment of the notebook. And, in addition, the material/thickness of the cover(s), overlaying the credit card organizer(s), is sufficient to prevent a thief from tactile feeling the credit cards through the cover.

The set of credit card holding slots in an organizer can be provided at the front and/or rear covers of the booklet device. These card-holding slots can be like those of traditional wallets which allow the very tops of the cards to be visible and the cards vertically offset and stacked for ease of removing and reinstalling. The front and rear covers of the booklet and the covering plates for the credit card organizers or holders are preferably formed from or with a thin metallic sheet of material, preferably from copper, aluminum, silver, and/or gold or alloys thereof. This will provide suitable RFID reader blocking of the data on the cards. And, in addition, behind the cards, in the pockets formed between the inside surface of the outside covers and the front surface of the metallic covering plates or sheets will be one or more holding pocket areas for folding and paper currency.

DETAILED DESCRIPTION OF THE DRAWINGS AND THE PREFERRED EMBODIMENT

The present invention is a concealed set of pocket(s) or credit card carrying set of organizing slots within a notebook or booklet to serve as a wallet that enables users to carry objects of importance or value, such as paper money, credit cards, and/or a passport, etc., safely and discretely. The carrier or compact organizer for the credit cards is much like that of ordinary wallets, i.e., it is a set of vertically stacked and staggered slots for holding the credit cards but displaying and visually showing only the top segment to aid in ease of identification and removal. The present invention will be described with respect to a single or set of credit card organizing or holding pockets for being concealed in the booklet, it being understood that the invention can have one or more organizers and/or holding pockets on the front and/or rear inside covers of the booklet. The invention is intended to conceal the contents of the booklet from a thief and the device is intended to distract the thief to believe that the holder is carrying a personal notebook, a compositional notebook or personal diary/booklet, as the same has the visual appearance of a small booklet (with lined and stacked pages bound by a spine) and the same is provided with a writing pen, too, to enhance the deceit.

Figure 3:
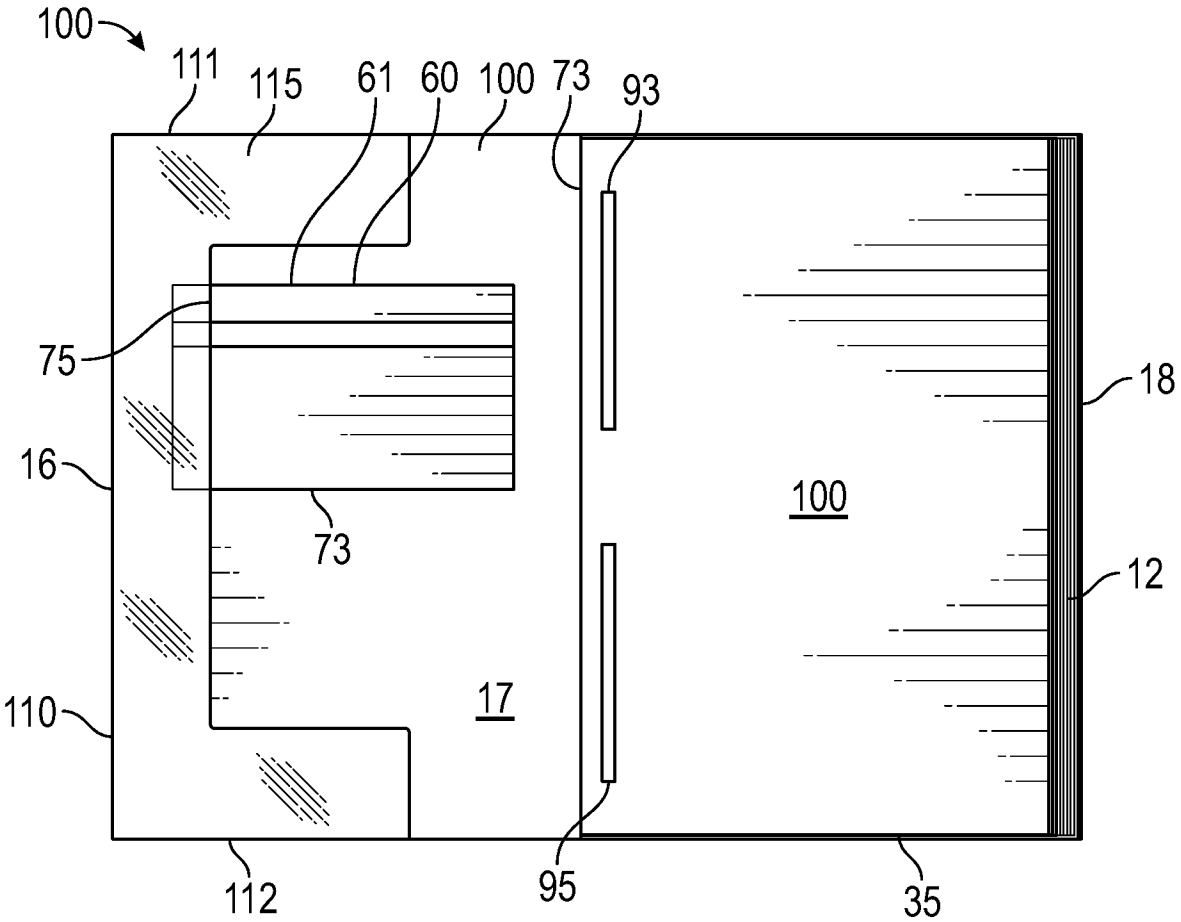
FIG. 3 is a top view of the invention, also in the open position, with the edges of the covering plate rolled out of and removed from the flanges/overlays, with the covering plate turned to be superimposed over the other pages of the booklet, and revealing the credit card organizers on the inside surface of the front and outer cover of the booklet.

The invention consists of, what appears to be, a notebook or booklet 10 having many stacked and lined pages 12, bound to a spine 13, and including an attached pen 14 (not shown in FIGS. 3, 3*a* and 4). The notebook has several pages stacked on top of one another, as in a booklet, which are bound on one end (at the spine 13) and has a front 16 and back cover 18. Preferably, the front cover 16 and back cover 18 are covered with attractive paper or material as that tends to look more like a poetry book, a book of personal thoughts, musings, food lists, a diary, etc. The pages may be bound to form a spine 13 by any means desired including glue or sewing and the covers secured in a conventional manner. For all visual intentions and purposes, the device appears to be a common compositional, personal notebook, booklet or pocket diary with lined and stacked pages bound by a single spine 13 and possibly including a writing instrument or pen 14. However, the owner uses the same as a mechanism to conceal his valuables—paper money, credit cards, driver's license, etc. while travelling away from home or even within one's home environment.

Preferably, the booklet 10 has an overlaying and stacked set of lined pages 19 which are quite ordinary, extending from the spine 13, to the open edge 31 (opposite the spine 13), to the top edges 33 and bottom edges 35 of the booklet 10. Preferably, these pages are lined so that if one opens the front or rear cover of the book 10, it appears as an ordinary writing booklet.

Figure 1:
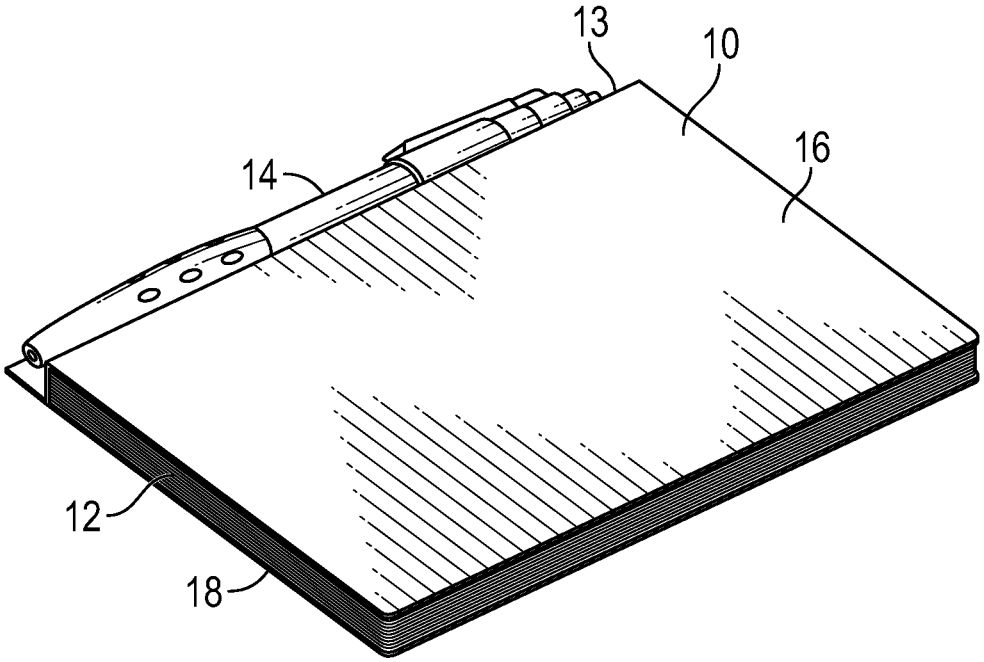
FIG. 1 is an angled perspective side, bottom edge and top view of the invention in the closed position.
Figure 2A:
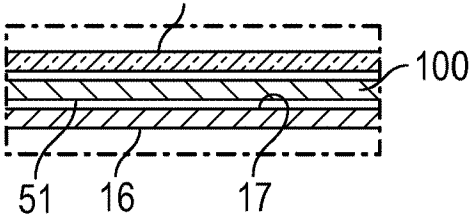
FIG. 2*a* is a cross sectional view taken along lines 2-2 of FIG. 2, and shows the outside cover of the booklet and the covering plate and the transparent, holding flanges/overlay.
Figure 2:
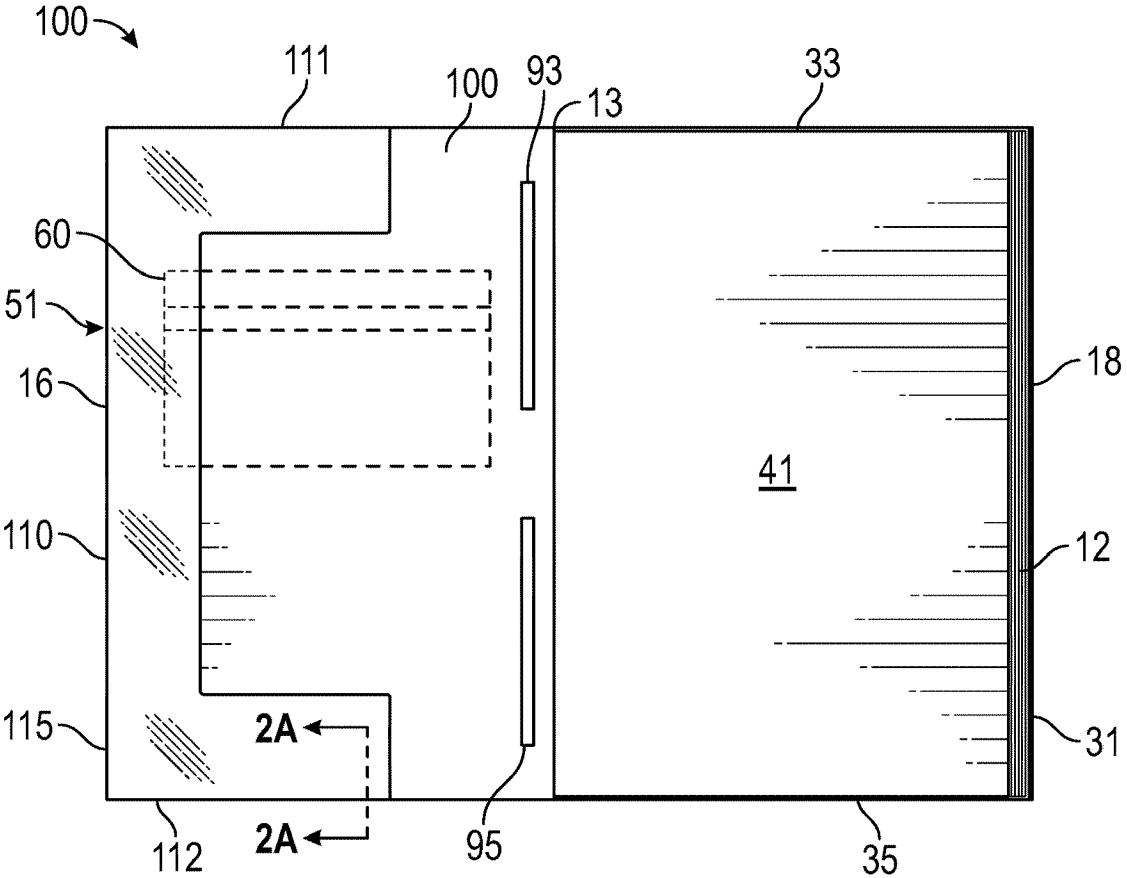
FIG. 2 is a top view of the invention in the position where the booklet is opened and the covering plate shown captured beneath and by the overlaying flanges/overlays, which are visible on and extend inwardly from the edges of the inside surface of the front cover and also showing the slots through the covering plate.

As can be seen in FIG. 2, the front page 41 of the booklet is lined. Indeed, if desired, all of the pages can be lined for ease of writing notes therein. The front cover 16 is preferably made of a thick, almost cardboard material to prevent a thief or another person from feeling through the cover and to the credit cards behind the cover. Preferably, the front cover and the rear cover, 16 and 18, respectively, are lined with thin, malleable, i.e., able to be rolled, sheets of metal. This will provide a tactile blocking of the inside of the booklet and, in addition, will block an RFID reader from penetrating the covers. In an alternate embodiment, the front cover 16 alone (or rear cover 18, alone) is lined and the covering plate 100 is the "other" side of the metal sandwich construction for blocking the RFID reader. The inside surface 17 (See FIG. 2A) of the front cover 16 is the inside or first surface of a holding pocket for the credit card organizer 60 with vertically stacked and staggered slots 61, which is between the inside surface 17 of the front cover 16 and the backside 51 of the covering plate 100. This can be seen in FIG. 2A. The credit card organizer 60, preferably, is adhered to the inside surface 17 of the front cover 16 on at least one edge, but preferably two edges, 73 and 75 (See FIG. 3) so that paper money slid into that pocket area (between inside surface 17 of front cover 16 and one surface or backside 51 of the covering plate 100, can slide into that space/area. The paper money, not shown, can be slid into that area behind the credit card organizer 60 through side slots 93 and 95 of covering plate 100, which are preferably aligned with the spine 13 but slightly indented from the spine. As shown, the top edge of the stacked and vertically stacked credit cards extend across the front cover, basically aligned with the lines of the pages of the booklet. However, in an alternate embodiment, the top edges of the credit cards and thus the credit card organizer can extend parallel to the front edge of the cover.

The covering plate or sheet 100 is substantially coextensive with the other pages 12 and serves to cover the inside surface, the credit card organizer 60 and the paper money holding area on the inside of the front cover 16. The covering plate 100 can be lined with a thin, flexible, metallic and malleable layer of sheet metal, preferably, copper, aluminum, silver even gold and alloys thereof. The pocket formed between the inside surface 17 of the front cover 16 and the inside surface of the covering plate 100 is thus an RFID blocker, i.e., an RFID reader should not be able to penetrate the same and gain access to the data on credit cards. The covering plate 100 is sufficiently thick to form one side of the blocking area for the RFID reader and/or, alternatively, the back 18 of the booklet can be lined, too, with a thin metallic layer or sheet.

Extending around the free and outside edge 110, the top edge 111 and the bottom edge 112 of the front cover 16, on the inside 17 of the cover, i.e., covering a part of the inside surface 17 of front cover 16, is a set of contiguous flanges 115, in effect a preferably transparent holder or overlay. It extends from the outside edges 111, 112, and 110 inwardly, and forms a preferably indented, transparent set of continuous flanges for the edges of the covering plate 110 to be selectively held behind. When the edges of the flexible, covering plate 100 is slid behind the transparent flanges or overlay 115, the covering plate 100 is substantially coextensive with the inside surface 17 of the front cover 16 so that the covering plate 100 covers the inside surface 17 of the front cover 16. A pocket is thus formed between the covering plate 100 and the inside surface 17 of the front cover 16. The free outward edges of the covering plate 100 are behind the flange/overlay 115, held there to cover and hide the credit card organizer 60, the credit cards contained therein, and the holding pocket area for the folding money, behind the organizer 60.

When access is desired to the credit cards and/or the paper money, the user needs to remove, by rolling and sliding the free edges of the covering plate 100 towards the spine 13, by removing its edges from beneath the flange overlay 115, to expose the credit card organizer 60 and provide access to the holding area for the paper funds.

As can be seen in FIGS. 2 and 3, slots 93 and 95 are provided through the covering plate 100 so that paper money can be folded and slid therethrough to store money behind the covering plate and the credit card organizer 60—even with the covering plate in its first, original and "hiding" position of credit cards. FIG. 2 shows the covering plate 100 overlaying the inside surface 17 of the front cover 16 (with the edges of the covering plate 100 overlying the lined pages 12 of the booklet 10, when access to the credit card organizer 60 and the paper folded money is not desired but rather camouflaging is desired. In this Figure, the covering plate 100 is superimposed over the inside surface 17 of the front cover 16. When the covering plate 100 is slid out from the overlay 115, and the covering plate turned over the other pages 12, as shown in FIG. 3, the credit card organizer 60 is visible.

Information theft is common and pervasive today. It may occur not by necessarily physically stealing the actual document(s) or items but by remotely scanning documents having electronic tags, such as RFID tags, electronic strips, machine readable items which are maintained in the user's/owner's possession. This type of theft does not require that someone physically obtain the cards or documents but instead can be done by positioning an electronic scanner or RFID reader near the item and scanning the item without the document ever leaving the possession of the owner. Thieves then have access to the information stored and can use this information for identity theft, human trafficking, theft of goods and services and similar crimes. Often the information is quickly sold to a third party who improperly uses the same for another nefarious purpose.

To prevent a thief from scanning documents, the front and/or back covers 16 and/or 18 of the booklet 10 or at least the surfaces surrounding the credit card organizer 60 (e.g., the inside surface 17 of cover 16 and the front or opposing surface of the covering plate 100) are preferably provided with a thin, flexible sheet of metal. Preferably, the thin metal plate is covered with cardboard or paper or fabric to make the overall device attractive and to provide the tactile feel blockage referred to above. While both front and back could be metal lined, the back cover 18 need not be if the card organizer is only in the front of the booklet 10 and the covering plate 100 is lined. Or, the front, the back covers and/or the covering plate can be metal lined. The metal plate may be sandwiched between pieces of soft fabric and/or attractive material making up the cover(s) 16 and 18 or may be attached to the inside surfaces of the cover(s). Preferably the metal sheet is lightweight, flexible, rollable and thin and is covered on all sides or has rounded edges to prevent causing harm or damage to the user and surrounding things. Electronic scanners cannot penetrate metal and therefore the metal plate(s) prevent an unauthorized person from scanning information from documents especially credit card magnetic strips, to the extent contained within the notebook or booklet 10. The metal plate may be comprised of thin sheet steel, aluminum, copper, silver, even gold, or alloys or other thin metallic sheets and should be sized to cover at least the dimensions of the holding pockets and/or the credit card organizer 60 to adequately protect the credit cards.

The notebook also includes a writing implement, an attached pen 14 in the preferred embodiment. The pen 14 may be attached by any means a manufacturer desires.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. A camouflaging device for storing valuables which device appears to be a book comprising:

a booklet having a front cover and a back cover, said front cover and said back cover both having inside planar surfaces defined by parallel, outwardly and inwardly-located longitudinal edges, a top edge and a bottom edge, a central spine defining a paper turning axis, having one or more sheets of paper with edges, said sheets being held by one of their edges of said sheets of paper rotatable about said central spine, a malleable covering plate defined by a pair of parallel longitudinal edges defining a surface therebetween of a size corresponding to said pages, with one of said longitudinal edges of said covering plate being also connected to said central spine, said covering plate also being turnable about said central spine, wherein a pocket is formed between said inside surface of either said front cover or said back cover and said surface of said covering plate, said covering plate, in a first position, sliding over and covering said pocket for hiding said pocket from view and, yet, in a second position, when turned about said longitudinal axis, said covering plate exposing the contents of said pocket, and said pocket holding a credit card organizer wherein said covering plate is held flat and covering said credit card organizer, when in said first position, by an inwardly recessed, flange and transparent overlay which extends inwardly from the top edge, said bottom edge and said outward edge of said inside surface of said front cover or said back cover.

2. A device as claimed in claim 1 wherein said credit card organizer is secured to the inside surface of said front cover on one, two or three ends of the credit card organizer so that a holding area is formed behind said credit card organizer for paper money.

3. A device as claimed in claim 1 wherein said front cover and/or said back cover comprise multiple layers of material and at least one of said layers of material is a layer of metallic sheet.

4. A device as claimed in claim 1 wherein said front and back covers are both provided with a layer of metallic sheet to block an RFID reader.

5. A device as claimed in claim 1 wherein said covering plate is provided with one or more slots to allow folding money to pass into said pocket behind said credit card organizer.

* * * * *